US005918470A

United States Patent [19]

Xu et al.

[11] Patent Number: 5,918,470

[45] Date of Patent: Jul. 6, 1999

[54] THERMAL CONDUCTANCE GASKET FOR ZERO BOILOFF SUPERCONDUCTING MAGNET

[75] Inventors: In-Hua Xu; Daniel C. Woods; William S. Stogner, all of Florence, S.C.

[73] Assignee: General Electric Company, Milwaukee, Wis.

[21] Appl. No.: 09/120,431

[22] Filed: Jul. 22, 1998

[51] Int. Cl.[6] ..... F25B 19/00

[52] U.S. Cl. ..... 62/51.1; 62/6; 62/383; 505/894; 335/216; 335/300

[58] Field of Search ..... 335/216, 300; 62/51.1, 55.5, 383, 6; 505/888, 894, 895

[56] References Cited

U.S. PATENT DOCUMENTS 5,247,800 9/1993 Mruzek et al. ..... 62/51.1

5,509,243 4/1996 Bettigole et al. ..... 52/334

5,701,742 12/1997 Eckels et al. ..... 62/6

*Primary Examiner*—Michael L. Gellner

*Assistant Examiner*—Tuyen Nguyen

*Attorney, Agent, or Firm*—Irving M. Freedman; Christian G. Cabou; Phyllis Y. Price

[57] ABSTRACT

A recondensing zero boiloff superconducting magnet assembly utilizing a cryocooler with a compressible indium gasket positioned between the cryocooler and the recondenser and with the gasket containing a plurality of spaced parallel grid wires with interconnecting web segments of a lesser thickness interconnecting the mid sections of ends of adjacent wires to facilitate compression of the gasket to control improved thermal conductivity while minimizing the pressure and forces on the assembly.

13 Claims, 2 Drawing Sheets

THERMAL CONDUCTANCE GASKET FOR ZERO BOILOFF SUPERCONDUCTING MAGNET

BACKGROUND OF INVENTION

This invention relates to a helium cooled superconducting magnet assembly suitable for magnetic resonance imaging (hereinafter called "MRI") utilizing a mechanical cryocooler and recondenser for recondensing the resultant helium gas back into liquid helium, and more particularly to improved efficiency and simplified gaskets for thermally connecting the cryocooler to the recondenser of the superconducting magnet.

As is well known, a superconducting magnet can be made superconducting by placing it in an extremely cold environment, such as by enclosing it in a cryostat or pressure vessel containing a cryogen such as liquid helium. The extreme cold maintains current flow through the magnet coils after a power source initially connected to the coil (for a relatively short period) is disconnected due to the absence of electrical resistance in the cold magnet coils, thereby maintaining a strong magnetic field. Superconducting magnet assemblies find wide application in the field of MRI.

The provision and storing of a steady supply of liquid helium to MRI installations all over the world has proved to be difficult and costly leading to considerable research and development efforts directed at minimizing the need to replenish the boiling liquid helium such as by recondensing the resultant helium gas.

Superconducting magnets which recondense the helium gas back to liquid helium are often referred to as zero boiloff (ZBO) magnets. The helium gas formed by the boiling of liquid helium in the superconducting magnet helium pressure vessel is flowed through passageways in the recondenser cooled by the cryocooler to recondense the helium gas back to liquid helium for return to the liquid helium bath in the pressure vessel. The efficient thermal coupling of the mechanical refrigerator or cryocooler to the recondenser is extremely important because the cryocooler cooling capacity and operational limits are often approached in a ZBO superconducting magnet, taxing the thermal ability of the system to provide the necessary cooling for recondensing the helium gas. In addition, it is necessary to accomplish this while facilitating insertion and adjustment of the cryocooler in the superconducting magnet assembly without damaging the cryocooler by exerting excessive pressure on the cryocooler to obtain the efficient thermal coupling required in such a system.

U.S. Pat. No. 5,701,742, issued Dec. 30, 1997 and assigned to the assignee of the subject patent, discloses the use of a deformable indium gasket for the thermal coupling interface to decrease the coupling pressure required. However, it has been found necessary in some ZBO superconducting magnets to further increase the thermal efficiency to ensure adequate cooling because of marginal cooling capability of some ZBO magnet assemblies while further minimizing coupling pressure to avoid possible damage to the cryocooler. This invention thus constitutes an improvement over that of the aforementioned U.S. Pat. No. 5,701,742 invention.

Indium, while soft and pliable at room temperatures, has proven to be extremely hard and difficult to properly compress when at superconducting temperatures. Slight imperfections and variations in thickness have required so much pressure on the gasket for good thermal conductance as to strip the threads of adjustment screws or damage the cryocooler housing. Obtaining uniform optimum thermal conductance across the thermal interface gasket with a minimum applied pressure has often been difficult or elusive.

As a result, it becomes extremely important to provide an improved yet uncomplex efficient thermal coupling between the cryocooler and recondenser to enable efficient recondensing of the helium gas back to liquid helium in a ZBO superconducting magnet.

SUMMARY OF INVENTION

Thus, there is a particular need for an improved cryocooler system for cooling the helium recondenser which efficiently overcomes the aforementioned problems and provides the thermally efficient coupling between the cryocooler and recondenser without damaging the cryocooler due to the thermal coupling pressure required.

In accordance with one form of the invention, a zero boiloff helium-cooled superconducting magnet utilizing a mechanical cryocooler and helium gas recondenser with a sleeve into which the cryocooler may be inserted and removed with minimum disruption on MRI superconducting operation includes a gasket intermediate and thermally interconnecting the cryocooler and recondenser. The gasket is substantially pure indium and includes a plurality of substantially parallel grid wires extending between opposite peripheries of thinner outer ring web segments which are of a thickness less than the grid wires and interconnect the mid sections of the ends of the grid wires. Means are provided to facilitate installation of the cryocooler into the sleeve and to adjust the pressure of the thermal interface therebetween.

DESCRIPTION OF DRAWINGS AND INVENTION

Figure 1:
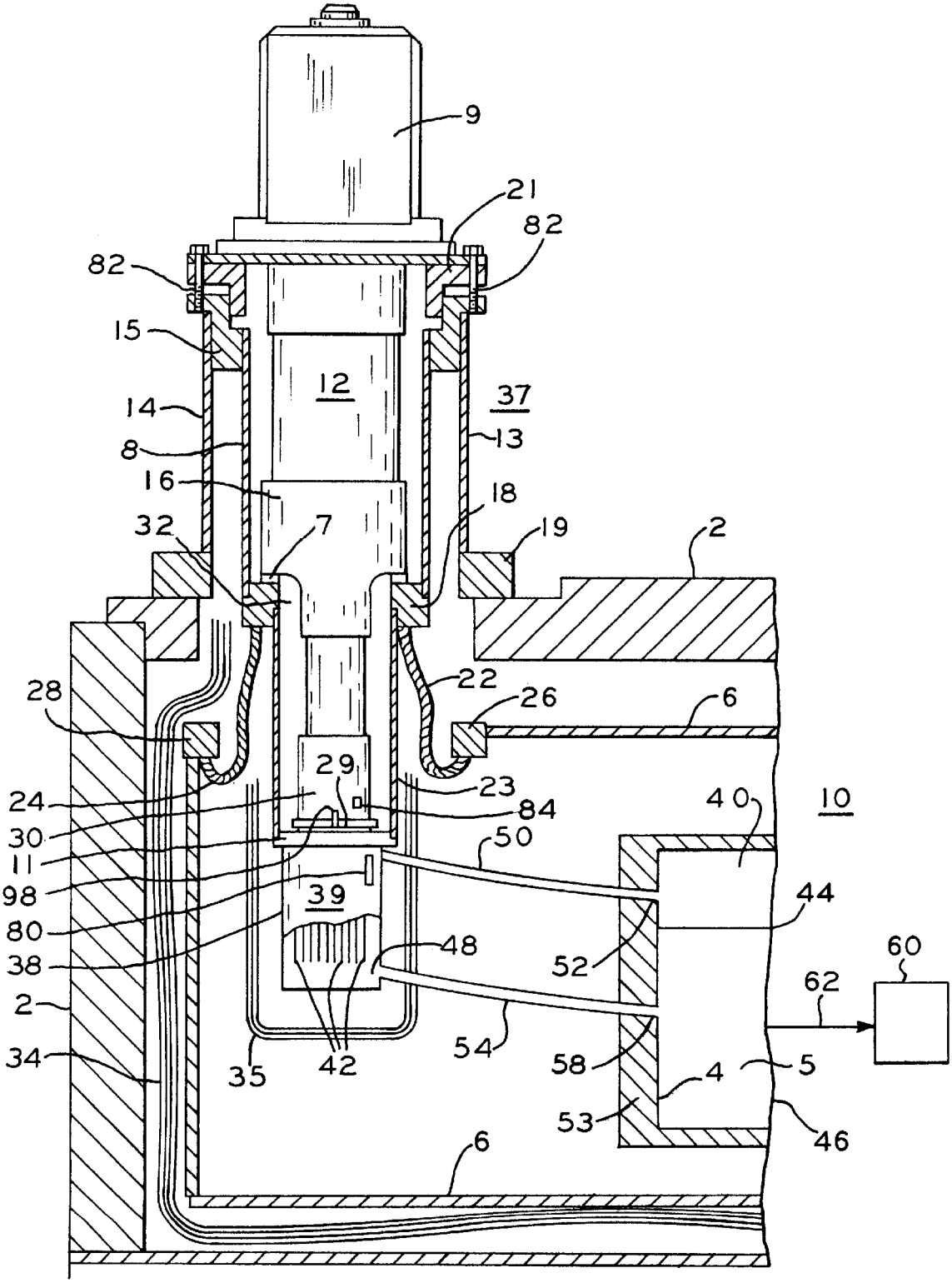
FIG. 1 is a cross-section of a portion of a MRI superconducting magnet shown in simplified form incorporating the present invention.

Referring first to FIG. 1, MRI magnet system 10 includes helium pressure vessel 4 including a liquid cryogen such as helium 5. Thermally isolating radiation shield 6 is interposed between helium vessel 4 and surrounding vacuum vessel 2. A two-stage cryocooler 12 (which may be a Gifford-McMahon type cryocooler extends through vacuum vessel 2 within sleeve 8 such that the cold end of the cryocooler may be selectively positioned within the sleeve to contact thermal interface gasket 29 without destroying the vacuum within the vacuum vessel. Heat generated by motor 9 of cryocooler 12 is kept on outside 37 of vacuum vessel 2. External cryocooler sleeve ring 14 extends outside vacuum vessel 2, and collar 19 and sleeve flange 15 enable the securing of outer cryocooler sleeve 13 to vacuum vessel 2. Cryocooler 12 is installed in the interior 32 of cryocooler sleeve assembly 8, 18, 23 with matching transition flange 21 and secured in position with bolts 82 and associated washers (not shown) which pass through the flange 21 to sleeve flange 15 without disturbing the vacuum in vacuum vessel 2.

First stage heat station 16 of cryocooler 12 extends into cavity 32 of sleeve assembly 8, 18, 23 and contacts copper first stage thermal sleeve or heat sink 18 through thermal gasket 7. Heat sink 18 is thermally connected through braided copper flexible thermal couplings 22 and 24 and copper thermal blocks 26 and 28 on isolating radiation shield 6 to cool the radiation shield to a temperature of approximately 55K providing thermal isolation between helium vessel 4 and vacuum vessel 2. Flexible couplings 22 and 24 also provide mechanical or vibration isolation between cryocooler 12 and radiation shield 6.

In addition to cooling radiation shield 6 by first stage 16 of cryocooler 12, superinsulation 34 and 35 is provided to further thermally isolate helium vessel 4 from vacuum vessel 2.

The bottom surface of second stage heat station or cold head 30 of cryocooler 12 contacts indium gasket 29 to thermally connect the cryocooler to heat sink 11 of recondenser 39 positioned on the opposite side of the indium gasket.

Extending below, and thermally connected to, heat sink 11 is helium recondensing chamber 38, made of high thermal conductivity material such as copper, which includes a plurality of substantially parallel heat transfer plates or surfaces 42 in thermal contact with heat sink 11 and forming passages between the surfaces of the plates for the flow of helium gas from helium pressure vessel 4.

Helium gas 40 forms above liquid helium surface level 44 of liquid helium supply 46 through the boiling of the liquid helium in providing cryogenic temperatures to MRI magnet system 10. Helium gas 40 passes through gas passageway 52, through the wall 53 of helium vessel 4, and through helium gas passage 50 to the interior of the upper portion 41 of helium recondensing chamber or canister 38. Heat transfer plates 42 within recondenser 39 are cooled to 4K by second stage 30 of cryocooler 12, such that helium gas 40 passing between the plates recondenses into liquid helium to collect in bottom region 48 of helium recondensing chamber 38. The recondensed liquid helium then flows by gravity through helium return line 54 and liquid helium passage 58 in helium vessel 4 back to liquid helium supply 46.

During operation of MRI magnet system or assembly 10 liquid helium 46 cools superconducting magnet coil assembly (shown generally as 60) to a superconducting temperature with the cooling indicated generally by arrow 62 in the manner well known in the MRI art without system loss of helium because of the recondensing ZBO. Helium gas 40 instead of being vented to the surrounding atmosphere 37 as is common in many MRI equipments, flows as described above from helium pressure vessel 4 to the interior of helium recondensing chamber 38 to pass between cryocooler cooled heat transfer plates 42 to recondense back to liquid helium which flows by gravity 4 back to liquid helium supply 46, thus returning the recondensed helium gas back to the liquid helium supply as liquid helium in a closed loop system.

Figure 2:
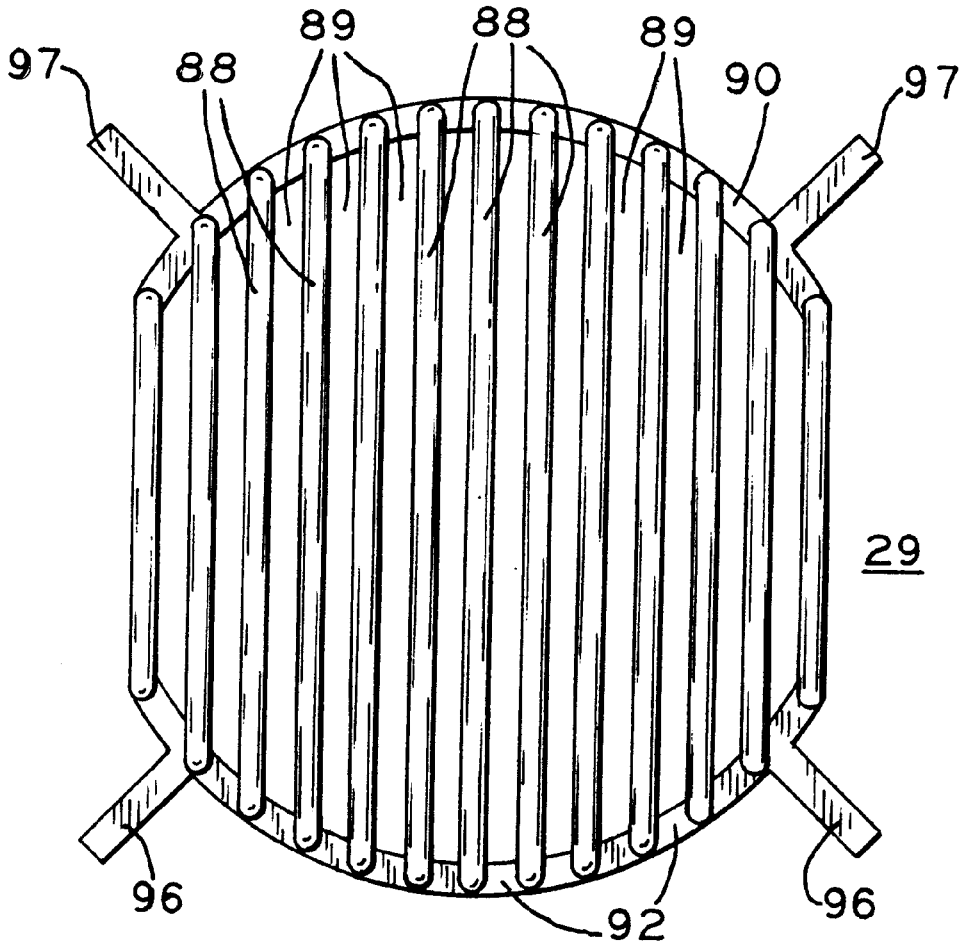
FIG. 2 is an enlarged view of the thermal gasket shown in FIG. 1.

Referring next to FIG. 2, wire thermal gasket 29 includes 13 spaced cylindrical wires such as 88 each of which is 99.99 percent indium, 0.060 inches in diameter and connected at their ends to planar connecting segments or web members of opposing radial arcs 90 and 92. Radial arcs 90 and 92 have an outer diameter of 1.98 inches which is suitable for use with a cryocooler 12 with a second stage 30 bottom diameter of 2.05 inches. The spaces or openings 89 between wires 88 are approximately 1.5 times the diameter of the wires; that is, the spaces between the wires are wider than the wires.

Arcuate connecting segments 90 and 92 are 0.07 inches thick as are generally radially extending diametrically opposed tabs 96 and 97. Tabs 96 and 97 are bent into axial grooves 98 in the cold head or second stage heat station 30 of cryocooler 12 (see FIG. 1) to facilitate retention on the cryocooler cold head or second stage 30. Tabs 96 and 97 may conveniently be soldered in axial grooves 98 to retain gasket 96 on cryocooler 12 during insertion and removal of the cryocooler. A replacement gasket 96 may be substituted for a deformed gasket before reinsertion of cryocooler 12 after servicing of the cryocooler.

Referring again to FIG. 1, after insertion of cryocooler 12 into cryocooler sleeve assembly 8, 18, 23 bolts 82 are selectively tightened to press cryocooler 12 against indium gasket 29 with a sufficient pressure to deform gasket 29 by cold flow yield of the indium wires 88 into intervening spaces 89. This ensures good thermal contact as detected by the temperature differential, if any, sensed by temperature sensors 80 and 84 on opposite sides of thermal inteface 29 without overtightening and possibly damaging cryocooler 12 or gasket 29.

Figure 3:
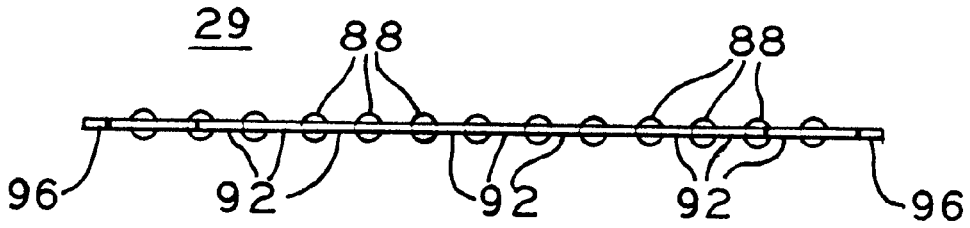
FIG. 3 is an end view of FIG. 2.

Referring next to FIG. 3, it is noted that grid wires 88 of gasket 29 are of a greater diameter than the thickness of planar arcuate segments 92 and that the arcuate segments connect the central regions of adjacent wires. This facilitates the deformation of wires 88 under pressure upon the tightening of bolts 82 causing gasket material to flow into spaces 89 between the wires. Any trapped gases between grid wires 88 can readily pass over or under intervening arcuate segments 92 as the contact regions between wires 88 with cold head 24 and heat sink 11 gradually increase with the movement of cryocooler 12 towards recondenser 39 upon tightening of bolts 82 and deformation or flattening of the wires filling spaces 89 between the wires.

Upon the tightening with a minimum of pressure on, and without damage to, cryocooler 12 the temperature drop or loss across thermal coupling 30, 29, 11 is obtainable in the desirable and acceptable range of 0.15–0.30 K. Cryocooler 12 when utilized in a ZBO recondensing magnet has been found to be unable to provide the sufficient cooling required for maintaining zero boiloff conditions with a temperature drop across thermal coupling 30, 29, 11 of as little as 1K. This is why increasing the thermal efficiency or thermal coupling 30, 29, 11 is so important.

While conventional wisdom might suggest that a gasket with flat grid wires and/or without webs of a lesser thickness than the wires should provide a better thermal conductivity joint, gasket 29 has proved to be dependable and readily adjustable for optimized thermal conductivity with minimum pressure on the wires to avoid potential damage to cryocooler 12 or the thermal coupling.

While the present invention has been described with respect to certain preferred embodiments thereof, it is to be understood that numerous variations in the details of construction, the arrangement and combination of parts, and the types of materials used may be made without departing from the spirit and scope of the invention.

What is claimed is:

1. A zero boiloff liquid helium cooled recondensing superconducting magnet assembly suitable for magnetic resonance imaging comprising:

a helium pressure vessel to contain a liquid helium reservoir to provide cryogenic temperatures to said magnetic resonance imaging magnet assembly for superconducting operation;

a recondenser and a cryocooler for cooling said recondenser to recondense helium gas formed in said pressure vessel back to liquid helium;

a thermal interface between said recondenser and said cryocooler; and said thermal interface including a deformable gasket and means to selectively press said cryocooler toward said recondenser;

said gasket including a plurality of spaced grid wires extending across said gasket and connected at their ends by web members spanning the spaces between said wires and having a thickness less than said wires.

2. The zero boiloff superconducting magnet of claim 1 wherein the grids are substantially parallel to each other with spaces between said grids being wider than the diameter of said wires to accommodate the compression of said wires upon pressing of said cryocooler toward said recondenser.

3. The zero boiloff superconducting magnet of claim 2 wherein said spaces between said grids are approximately 1.5 times wider than the diameter of said wires.

4. The zero boiloff superconducting magnet of claim 3 wherein said gasket is substantially pure indium.

5. The zero boiloff superconducting magnet of claim 4 wherein a plurality of tabs extend substantially diagonally from said web members to facilitate the securing of said gasket to said cryocooler.

6. The zero boiloff superconducting magnet of claim 5 wherein said cryocooler includes a cold head and said cold head includes grooves to accommodate said tabs of said gasket to enable insertion and removal of said gasket with said cryocooler.

7. The zero boiloff superconducting magnet of claim 2 wherein said web members are arcuate segments forming an arcuate perimeter with a diameter less than that of said cryocooler at said thermal interface.

8. The zero boiloff superconducting magnet of claim 7 wherein said arcuate segments are substantially planar and interconnect the mid sections of the ends of adjacent grids.

9. The zero boiloff superconducting magnet of claim 8 wherein the thickness of said arcuate segments is less than the diameter of said grids to facilitate compression of said grids and enable the escape of gasses between said wires during said compression.

10. The zero boiloff superconducting magnet of claim 8 wherein said gasket is substantially pure indium and is positioned and compressible between the cold head of said cryocooler and said heat sink.

11. The zero boiloff superconducting magnet of claim 10 wherein said superconducting magnet includes a vacuum vessel surrounding said helium vessel and a sleeve in said vacuum vessel to enable insertion of said cryocooler without breaching the vacuum of said vacuum vessel to enable said cryocooler to contact said gasket, and said thermal interface includes a heat sink on the interior of said sleeve contacting said gasket and thermally connected to said recondenser.

12. The zero boiloff superconducting magnet of claim 7 wherein said means to selectively press said cryocooler toward said recondenser compresses said gasket to provide a thermal interface between said cryocooler and said recondenser with a temperature drop of less than approximately 0.30K through said thermal interface.

13. The zero boiloff magnet of claim 12 wherein temperature detectors are positioned on opposite sides of said thermal interface to indicate said temperature drop as a measure of thermal efficiency.

* * * * *